US005467518A

United States Patent [19]

Mertens

[11] Patent Number: 5,467,518

[45] Date of Patent: Nov. 21, 1995

[54] METHOD OF AND APPARATUS FOR CONTINUOUSLY CASTING AND ROLLING DOWN THIN SLABS

[75] Inventor: Werner Mertens, Viersen, Germany

[73] Assignee: SMS Schloemann-Siemag Aktiengesellschaft, Düsseldorf, Germany

[21] Appl. No.: 135,838

[22] Filed: Oct. 13, 1993

[30] Foreign Application Priority Data

Oct. 13, 1992 [DE] Germany ..... 42 34 455.7

[51] Int. Cl.[6] ..... B21B 1/46; B21B 13/22

[52] U.S. Cl. ..... 29/527.7; 29/33 C

[58] Field of Search ..... 164/476, 417; 29/33 C, 527.7

[56] References Cited

U.S. PATENT DOCUMENTS

| | | | |
|---|---|---|---|
| 4,998,338 | 3/1991 | Seidel et al. | 164/476 X |
| 5,035,036 | 7/1991 | Bohnenkamp | 29/33 C |
| 5,075,953 | 12/1991 | Braud | 29/33 C X |
| 5,115,547 | 5/1992 | Rohde | 164/417 X |
| 5,182,847 | 2/1993 | Guse et al. | 29/33 C X |
| 5,212,856 | 5/1993 | DiGiusto et al. | 29/33 C |
| 5,305,515 | 4/1994 | Fastert et al. | 29/33 C X |

FOREIGN PATENT DOCUMENTS

| | | | |
|---|---|---|---|
| 3708050 | 9/1988 | Germany | 164/417 |
| 3741220 | 6/1989 | Germany | 164/417 |
| 58-6701 | 1/1983 | Japan | 164/417 |
| 60-96302 | 5/1985 | Japan | 29/527.7 |
| 62-38704 | 2/1987 | Japan | 29/527.7 |

*Primary Examiner*—J. Reed Batten, Jr.

*Attorney, Agent, or Firm*—Anderson Kill Olick & Oshinsky

[57] ABSTRACT

Hot rolled wide strips from a continuously cast strand are rolled down in a pitch line, which includes a rolling train. A separate thin slab is cut off from the cast strand in one of two casting lines arranged on the opposite sides of the pitch line, and is homogenized and brought to a predetermined temperature in an equalizing furnace arranged coaxially with a respective casting line. The thin slab is then transported from the equalizing furnace into a movable furnace part formed as an equalizer, a buffer, or a regenerative furnace part and arrange coaxially with the equalizing furnace. The thin slab is then transported from the respective casting line to the pitch line in a direction opposite to the casting direction by pivoting or sidewise displacing the movable furnace part, after a first reverse of the direction of movement of the separate thin slab. The thin slab is transported after a second reversal of a direction of movement from the regenerative furnace to a holding furnace located downstream of the regenerative furnace, and therefrom to the rolling train for obtaining therein and end product.

11 Claims, 3 Drawing Sheets

METHOD OF AND APPARATUS FOR CONTINUOUSLY CASTING AND ROLLING DOWN THIN SLABS

BACKGROUND OF THE INVENTION

The invention relates to a method of and an arrangement for rolling down of hot-rolled wide strips from continuously cast thin slabs in successive operational steps in a pitch line, wherein a separate thin slab is cut off from a continuously cast strand produced in one of several casting lines, is homogenized and is brought up to a predetermined temperature in an equalizing furnace, is transported to a movable furnace portion formed as a regenerative portion, a buffer portion or an equalizer portion, as the case may be, and is then transported to a regenerative furnace arranged in the pitch line, from which the separate thin slab is transported to an additional holding furnace, if needed, and therefrom to the rolling train.

If the thin slab after casting is not reeled, it requires a rather long furnace installation. For example, a standard furnace installation for two or three casting lines provides for transporting of thin slabs longitudinally or transversely to a rolling train. Such a installation is described, for example, in European patent EPIO438,066. The arrangement described in this patent includes, for rolling down a hot-rolled wide strips from a thin slab in a continuous finishing train, three casting lines, wherein the middle casting line is arranged along the same line as the finishing train. The transportation of the thin slab from a casting line to the finishing train is effected by two "ferries", which operate as combined longitudinal/transverse/longitudinal transportation system, in which the "ferries" are selectively aligned sidewise with adjacent casting lines. Such a layout of the arrangement permits to achieve a substantial reduction of the cycle time of loading of thin slabs into the finishing train for producing hot-rolled thin strips, if the following conditions are maintained:

(a) the time of loading of a thin slab, which is separated from a cast strand, into longitudinal/transverse/ longitudinal transportation system corresponds to the time of unloading of a thin slab from the transportation system, and (b) the rolling-down time of a thin slab is greater than the transportation time of the longitudinal/transverse/ longitudinal transportation system plus loading or unloading time.

With this arrangement, it is important that each casting line cooperates with a furnace, an equalizing region and a buffer region, provided in front of the transportation system, and that downstream of the transportation system and before the finishing train, a holding furnace is provided.

With the known arrangement concept, the drawback of having a significantly long furnace installation is compensated by the reduction of the cycle time of loading of the finishing train. The length of the furnace installation is about 210 m, and providing such a furnace installation necessitates high investment expenditure for both the furnace installation and the shop construction.

In order to reduce the investment expenditure and the required area as well as to improve the temperature regime, EPO 413169 proposes another arrangement concept for producing steel strips with the use of one or several steel strip casting machines, together with associated temperature equalizing furnaces. According to this concept, the finishing train is arranged opposite the output conveyor of the steel strip casting installation and is offset relative to the conveyor, and an additional transportation temperature equalizing furnace is arranged sidewise of a transportation temperature equalizing furnace, which is arranged adjacent to the outlet of the steel strip casting installation. The additional temperature equalizing furnace is offset relative to the first temperature equalizing furnace in a direction of the strip displacement. The two temperature equalizing furnaces are connected by an end face crossover transportation device. This concept permits reduction of the length of the furnace installation almost by half. However, the drawback of this concept consists in that the furnace dwell time of the slab front and rear portions depends on the difference between the casting and feeding speeds and is increased due to the change of the movement direction. A further drawback is that the furnace installation must be closely associated with the casting installation.

An object of the present invention is to provide a method of rolling down of hot rolled wide strips from continuously cast thin slabs in successive operational steps in a pitch line, wherein a separate thin slab is cut off from a cast strand produced in one of several casting lines, is homogenized and is brought up to a predetermined temperature in an equalizing furnace, is transported to a movable furnace portion formed as a regenerative furnace portion, a buffer portion, or an equalizer portion, as the case may be, and is then transported to a regenerative furnace arranged in the pitch line, from which the separate thin slab is transported to an additional holding furnace, if needed, and therefrom to a rolling train.

Another object of the invention is a suitable arrangement for effecting the method and which would permit to reduce the length of the furnace installation in comparison with the rolling down arrangement in which the slab is transported straight forward, without any operational technical drawbacks or the need in a more complicated equipment.

SUMMARY OF THE INVENTION

An object of the invention is achieved by providing in a method of rolling down of hot-rolled thin strips from a continuously cast thin slab, which is discussed above, according to the invention, a step of pivoting or sidewise shifting a thin slab delivered from a cast line, by using a movable furnace part and transporting the thin slab, after a first reversal of the direction of its movement in a direction opposite to the casting direction into a regenerative furnace located in the pitch line; and a step of transporting the slab, after a second reversal of direction of its movement, from the regenerative furnace into a downstream holding furnace and from the holding furnace to the finishing train to produce an end product.

The method according to the present invention, due to the two-time reversal of the direction of movement of the material stream, permits to achieve a substantial reduction of the length of the furnace installation, without operational technical drawbacks. Despite the change of the movement direction of the material stream, no additional difference in the dwell time of the strip front and rear portions exists, besides the unavoidable difference, which results from the difference in speeds of the casting and rolling train installations. While the length of a furnace installation, with a straight-forward movement of the material stream with transverse displacement, is between 180–220 m, the length of the furnace installation for effecting the method according to the present invention, with a two-time change of the movement direction of the material stream, is 125–130 m.

According to one embodiment of the inventive method, the thin slab from a casting line is transported into a pivotable furnace part of the casting line, which is formed a as roller-bottom pivoting furnace, is pivoted, by the furnace part in a position inclined to the pitch line in a direction opposite to the casting direction, and is transported into a regenerative furnace of the pitch line, which is likewise formed as a roller-bottom pivoting furnace, with the regenerative furnace being pivoted into a position inclined to the pitch line at the same angle, as the pivotable furnace part, in the casting direction, so that the furnace part and the regenerative furnace extend along a common straight line. Thereby the thin slab, after a first reversal of its direction, is transported in the direction opposite to the casting direction and into the regenerative furnace of the pitch line. Thereafter, the furnace part of the casting line and the regenerative furnace are returned to their initial positions, and the thin slab, after a second reversal of direction, is transported from the regenerative furnace, through the holding furnace, which is located downstream of the regenerative furnace, into a finishing train.

According to another embodiment, the thin slab is transported into a movable furnace part, which is formed as a roller-bottom "ferry" furnace, and is then transported, by the "ferry" furnace, upon sidewise displacement of the "ferry" furnace relative to the casting line, into a regenerative furnace of the pitch line, which is likewise formed as a roller-bottom "ferry" furnace and is sidewise offset relative to the pitch line by the same amount as the furnace part of the casting line, so that the adjacent ends of the furnace part and the regenerative furnace are arranged along a straight line. Thereby, the thin slab, after a first reversal of its movement direction, is transported into the regenerative furnace.

Thereafter, the furnace part and the regenerative furnace are returned to their initial positions, and the thin slab, after a second reversal of its movement direction, is transported into a holding furnace and therefrom into a finishing train.

Finally, according to yet another embodiment of the method according to the present invention, the thin slab is transported into a movable furnace part of the casting line which is formed as a pivotable crank linkage of a roller-bottom furnace, and is then transported thereby, upon displacement of the furnace part relative to the casting line, into the intermediate space between the casting line and the pitch line and into a regenerative furnace of the pitch line, which is likewise formed as a pivotable crank linkage of a roller-bottom pivotable furnace and is displaced relative to the pitch line into the intermediate space between casting and the pitch line, so that the furnace part and the regenerative furnace have their adjacent end portions arranged along a common straight line. Thereby, the thin slab, after a first reversal of its movement direction, is transported into the regenerative furnace, in the direction opposite to the casting direction. Thereafter, the furnace part and the regenerative furnace are returned to their initial position, and the thin slab, after a second reversal of its movement direction is transported from the regenerative furnace into a holding furnace and therefrom into the finishing train.

The arrangement for rolling down of hot-rolled wide strips, which are cut off from continuously cast thin slab, in a pitch line including a finishing train, comprises at least two casting lines having each means for cutting off separate thin slabs, an equalizing furnace and a movable furnace part located downstream of the equalizing furnace and formed as a regenerative furnace portion, a buffer portion or an equalizer portion. For effecting the method according to the present invention, the arrangement according to the invention is characterized in that regenerative furnace is arranged in the pitch line, and the movable furnace part and the regenerative furnace includes means for connecting them with each other for transporting the separate thin slab from the casting line into the pitch line, and means which insures reversal of the direction of movement for transporting the separate thin slab.

The layout of the arrangement according to the invention provides for significant reduction of the total length of the furnace installation. This advantage is achieved by specific embodiments of the elements of the arrangement for a two-time reversal of the material stream, without a need in more complex technical means than that required for an arrangement with a straight forward transportation for the thin slabs with transverse displacement of the slabs.

BRIEF DESCRIPTION OF THE DRAWINGS

Further details, features and advantages of the invention will become apparent from the following Detailed Description of the Preferred Embodiments which are shown schematically in the drawings, wherein.

DETAILED DESCRIPTION OF THE PREFERRED EMBODIMENTS

Figure 1:
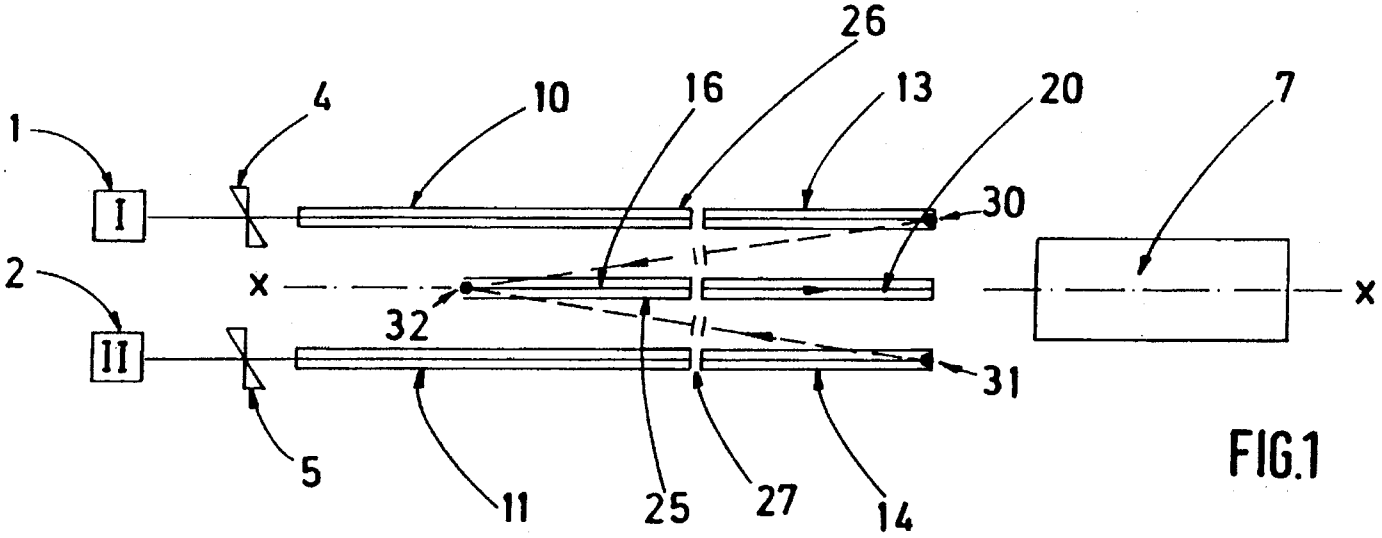
FIG. 1 is a continuously operating arrangement with two continuous casting machines, a finishing line, and a furnace enabling a two-time inversion of a direction of a thin slab.
Figure 2:
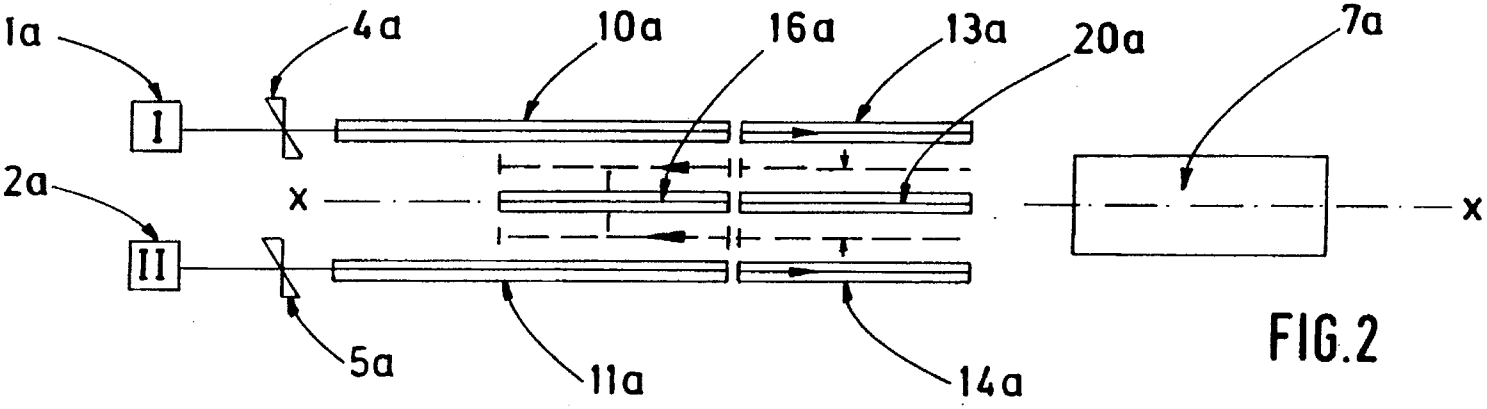
FIG. 2 is an arrangement according to FIG. 1 with another furnace design.
Figure 3:
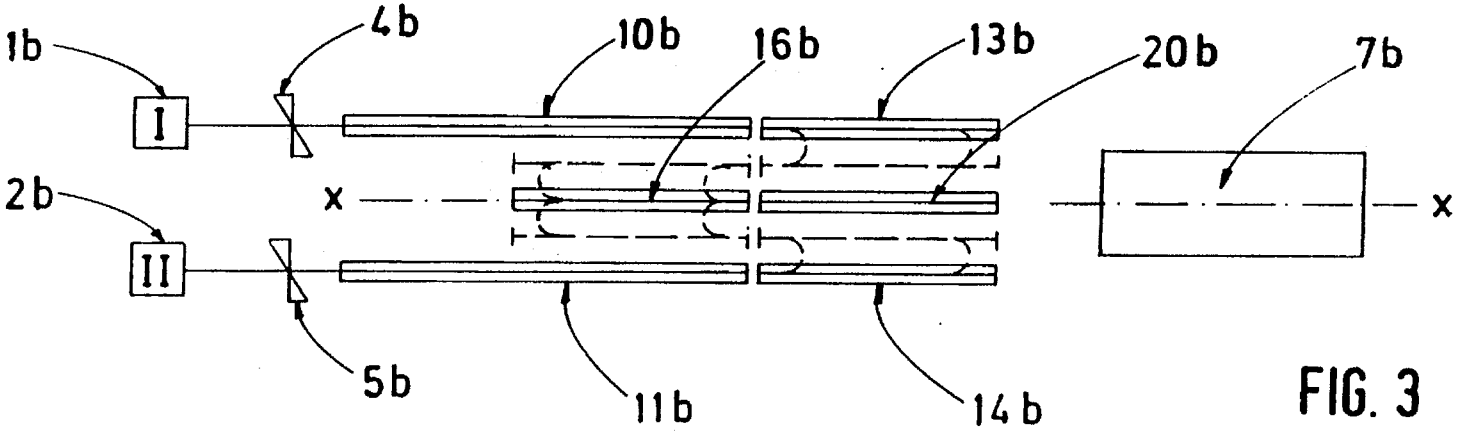
FIG. 3 is an arrangement according to FIG. 1 with yet another furnace design.

Referring now to the drawings, wherein like numerals reflect like elements, throughout the several views, FIGS. 1–3 show an apparatus for rolling down of a hot rolled wide strip from a continuously cast thin slab which includes a pitch line X-X with a continuous finishing train 7. The pitch line is associated with two casting machine or casting lines 1 and 2, designated in the drawings also with Roman numerals I and II, which extend parallel to the pitch line in a spaced relationship thereto. Each casting machine is associated with shears 4,5 for cutting off a single slab from a continuously cast strand. The shears 4,5 are arranged after the respective casting machines 1 and 2. The casting machine or line 1 is associated with an equalizing furnace 10 with a downstream movable furnace portion 13, which is formed as a regenerative furnace portion, a buffer portion, or an equalizer portion. The casting machine in line 2 is associated with an equalizing furnace 11 with a downstream movable furnace portion 14, which is formed as a regenerative furnace portion, a buffer portion or an equalizer portion. A regenerative furnace 16 is arranged in the pitch line X-X, parallel and in a spaced relationship to the equalizing furnace 10 of the casting line 1. The end 25 of the regenerative furnace 16, which also faces the rolling train, is located in the same plane or substantially the same plane as ends 26 and 27 of the equalizing furnaces 10 and 11, which face the rolling train. The furnace portions 13 and 14 as well as the regenerative furnace 16, which cooperates therewith, are provided with means which insures a connection of furnace portions 13 and 14 with the regenerative furnace 16 for transferring of the slab from the casting line 1, 2 to the pitch line X-X, and are equipped with direction reversing means for transporting the slab. Advantageously, a holding furnace 20 is arranged downstream of the regenerative furnace 16 in the pitch line X-X.

In the embodiment shown in FIG. 1, the movable furnace portions 13 and 14 of the equalizing furnaces 10 and 11 and the regenerative furnace 16 are formed, respectively, as roller-bottom pivoting furnaces which are longitudinally offset relative to each other by approximately a length of the pivoting furnace. At that, the pivot points 30 and 31 of the pivoting furnace portions 13 and 14 are located at the rear ends thereof and the pivot point 32 of the pivoting regenerative furnace 16 is located at the front end thereof, so that a respective one of furnace pairs 13, 16 and 14, 16, in its tilting position, forms, in a switch-like manner, a linear crossover for transporting the thin slab from the casting line 1,2 to the pitch line X-X.

In the embodiment of the apparatus, which is shown in FIG. 2, as in the embodiment of the apparatus shown in FIG. 1, the pitch line is associated with two casting machines 1*a* and 2*a* which are associated with shears 4*a*, 5*a*, respectively. The pitch line X-X includes a rolling train 7*a*. In the embodiment of FIG. 2, movable furnace portions 13*a* and 14*a* of the equalizing roller-bottom furnaces 10*a* and 11*a*, as well as the regenerative furnace 16*a* are formed as a ferry with means for enabling longitudinal and/or transverse transportation of the thin slab, so that a respective furnace pair 13*a*, 16*a* or 14*a*, 16*a* forms, in their transverse transporting position in the intermediate space between the respective casting line 1*a*, 2*a* and the pitch line X-X, with their adjacent ends connected with each other, a linear crossover path for transporting the thin slab from the furnace portion 13*a* or 14*a* to the regenerative furnace 16*a* and, thus, from the casting line 1*a*, 2*a* to the pitch line X-X.

At that, the transportation of the thin slab from the furnace portion 13*a*, 14*a* to the regenerative furnace 16*a* is effected in a direction opposite to the casting direction. As soon as the thin slab is transferred to the regenerative furnace 16*a*, which is formed as a ferry, it is displaced into the pitch line X-X, and the thin slab, if needed, is transported from the regenerative furnace 16*a* into the downstream holding furnace 20*a* and therefrom with an acceleration of the transporting speed, into the rolling train 7*a*.

In the embodiment of the apparatus according to the invention, which is shown in FIG. 3, the pitch line is associated with two casting machines 1*b* and 2*b* which are associated with shears 4*b*, 5*b*, respectively, with the pitch line including a rolling train 7*b*. In the embodiment of FIG. 3, the respective movable furnace portions 13*b* and 14*b* of the equalizing roller-bottom furnaces 10*b* and 11*b*, as well as the regenerative furnace 16*b* are formed each as a pivotable furnace displaceable parallel to itself or, generally, as a four-bar pivotable furnace displaceable parallel to itself or, generally, as a four-bar pivotable furnace with a pivotable crank mechanism, so that a respective furnace pair 13*b*, 16*b* or 14*b*, 16*b*, in the position thereof obtained upon pivoting by 90° or 180°, have their adjacent ends connected in the intermediate space between the respective casting line 1*b*, 2*b* and the pitch line X-X. In this position, the thin slab is transported from the pivoted furnace portion 13*b*, 14*b* , into the regenerative furnace 16*b*, which is pivoted in opposite direction. Thereafter, the furnace portion 13*b*, 14*b* and the regenerative furnace 16*b* are pivoted to their initial positions. Then, the thin slab is transported from the regenerative furnace 16*b* into the holding furnace 20*b* and finally into the rolling train 7*b*.

Figure 4:
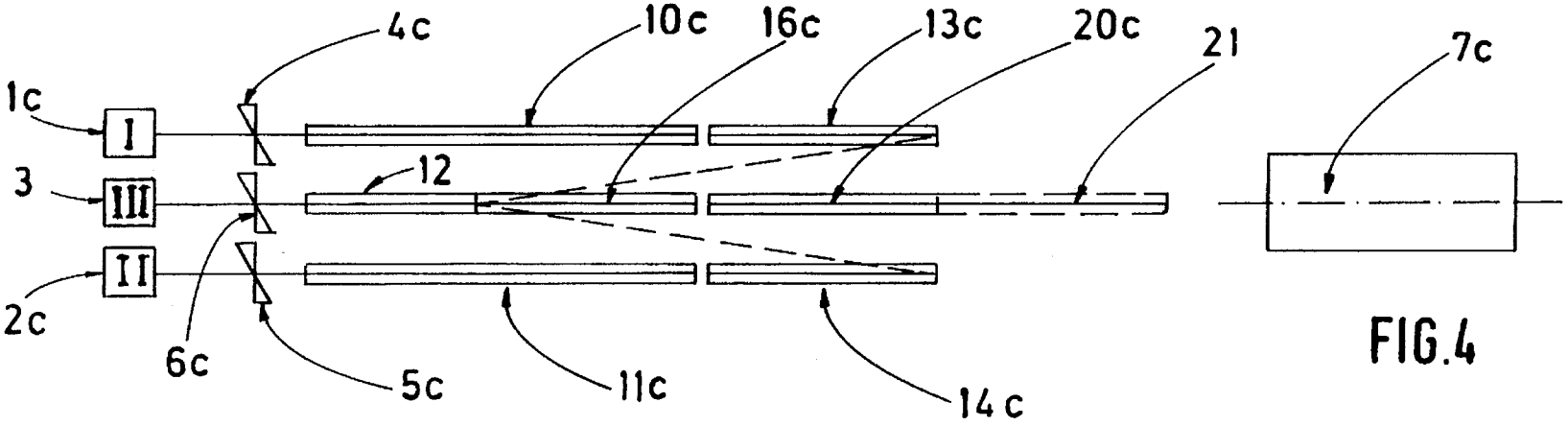
FIG. 4 is an arrangement with three casting lines and a pitch line which comprises a finishing train.

In the embodiment of the inventive apparatus shown in FIG. 4, the pitch line X-X, which includes a rolling train 7*c* is associated with two casting machines 1*c* and 2*c* followed by shears 4*c*, 5*c*, equalizing furnaces 10*c*, 11*c* and movable furnace portions 13*c*, 14*c*, respectively. The rolling train 7*c* is further associated with an additional casting line 3, with a shortened roller-bottom equalizing furnace 12 arranged downstream of the shears 6*c* of the casting line 3. The shortened equalizing furnace 12 is connected with a pivotal or displaceable parallel to itself furnace portion 16*c*, which is connected with a downstream holding furnace 20*c* or elongated holding furnace 20*c*, 21.

The length reduction of the furnace arrangement, according to the invention, is achieved by a two-time reversal of the direction of movement of the slab. In comparison with a furnace arrangement with unidirectional slab movement, there are no technical drawbacks. For effecting the reversal of the direction, movable elements, such as pivot means with a center of pivoting, parallel pivotable means or, generally, four-bar pivotable/crank mechanism can be used without difficulties. Altogether, a significant length reduction of the whole apparatus is obtained. With all other characteristics being equal, the length of the furnace arrangement for a unidirectional movement is as follows:

1. The length of a furnace arrangement for uni-directional movement with a crossover transportation is 180 or 210 m.
2. The length of a furnace arrangement with a two times reversal of direction is 135–130 m.

The length reduction of the furnace arrangement and thereby of the required space is achieved according to the invention with known and tested means, without need in additional elements.

Figures 5A, 5B, 5C:
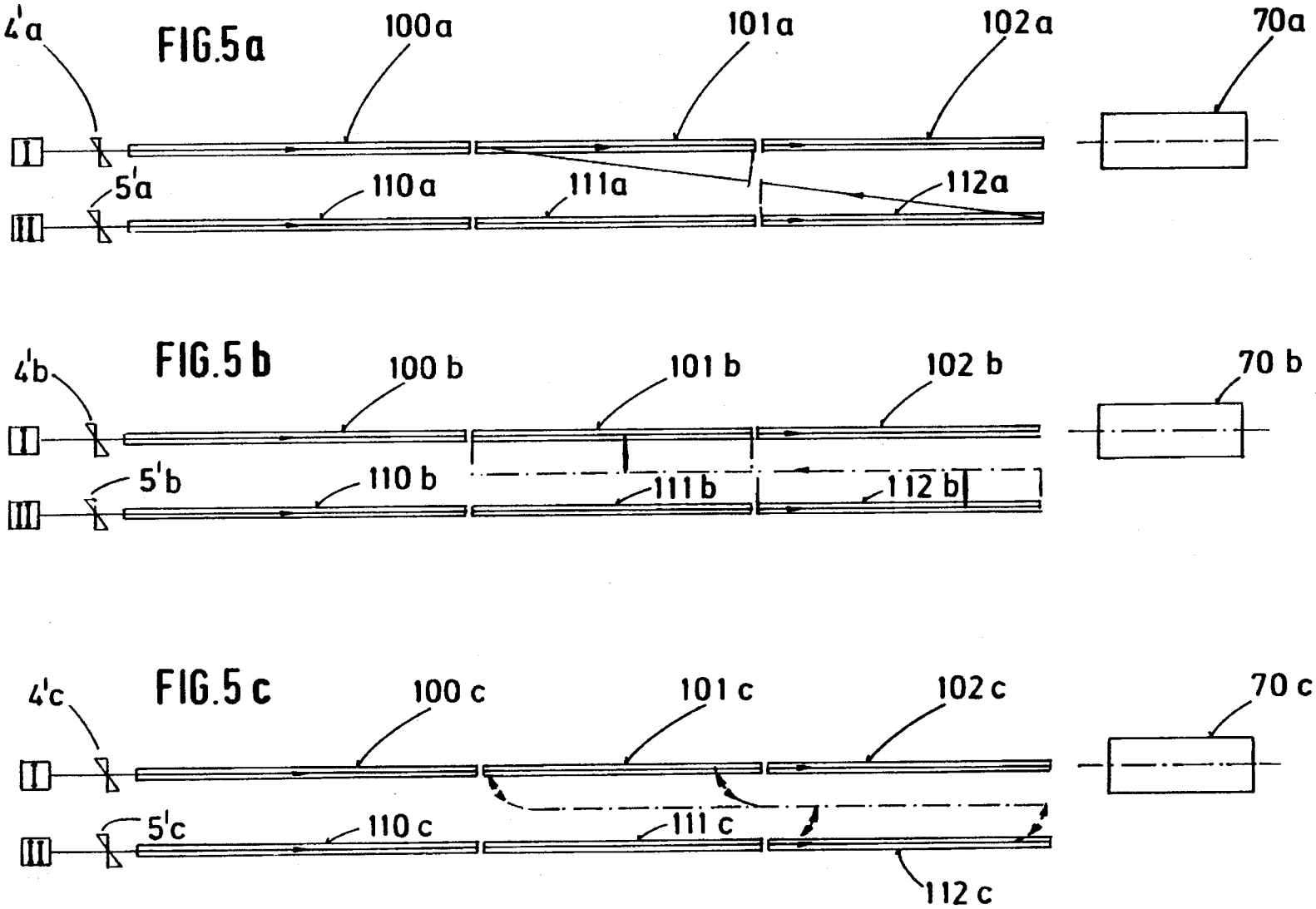
FIGS. 5*a*–5*c* are arrangements with two casting lines and a rolling mill train associated with one of the casting lines.

The invention is applicable not only to the continuous strip production apparatuses, which already, in the first constructional stage, should function as twin continuously operating installation, wherein, as in the discussed embodiments, the rolling train is arranged intermediate to the parallel rows of casting machines/furnaces. With broadening of the use of continuous strip production installations for producing hot-rolled strip, a second casting machine may only be added in the second constructional stage. Therefore, in the first constructional stage, the rolling train is provided in the same line as the casting machine/furnace arrangement. In the second constructional stage, only a second casting line/furnace line is added. The concept of modifying the apparatus in a second constructional stage is shown in FIGS. 5*a*–5*c*. Thus, the present invention is likewise applicable to so modified continuous strip production apparatuses or installations. While in this case only two operational lines are available, it is advantageous to transport the thin slabs in a reversed direction only from the second line. The advantage of this is that only two pivoting/ferry/crank mechanisms are needed. This concept provides for further reduction of the installation length. FIGS. 5*a*–5*c* show the same concept, according to which, in the second constructional stage, there are provided two rows of casting machines with downstream successively arranged shears 4*a*'–4'*c*, 5'*a*–5'*c*; equalizing furnaces 100*a*–100*c*, 110*a*–110*c*; regenerative furnaces 101*a*–101*c*, 111*a*–111*c*, elongate furnace portions 102*a*–102*c*, 112*a*–112*c*, which serve as holding furnaces and with which rolling trains 70*a*–70*c* are connected.

In the so modified installation, the respective regenerative furnaces 101*a*–101*c* of the casting line I and the holding furnaces 112*a*–112*c* of the casting line II are movable, with the movement being insured by a simple pivot furnace (FIG. 5*a*),a "ferry" (FIG. 5*b*) or a pivotable crank mechanism (FIG. 5*c*). The regenerative furnaces and the holding furnaces (101*a*, 112*a*), (101*b*, 112*b*), (101*c*, 112*c*) are paired in such a manner, that a respective furnace pair forms, at the end of their mutual movement, means for transporting the thin slab from the casting line II to the casting line I and thereby to the holding furnace 102*a*–102*c* of the rolling train 70*a*–70*c*.

I claim:

1. A method of continuously casting and rolling down a hot-rolled wide strip in successive operational steps in a pitch line including a regenerative furnace and a rolling train, said method comprising the steps of:

providing at least two casting lines for casting a cast strand and arranged on opposite sides of the pitch line;

continuously casting a cast strand in each of the at least two casting lines;

cutting off a thin slab from the cast strand cast in one of the casting lines;

homogenizing the thin slab and bringing it up to a predetermined temperature in an equalizing furnace arranged coaxially with a respective casting line;

transporting the thin slab from the equalizing furnace into a movable furnace part formed are one of an equalizer portion, a buffer portion and a regenerative furnace portion and arranged coaxially with the equalizing furnace;

transporting the thin slab from the respective casting line to the pitch line and into the regenerative furnace in a direction opposite to the casting direction, after a first reversal of the direction of movement of the thin slab, by one of pivoting and sidewise displacing the movable furnace part;

after a second reversal of the direction of movement of the thin slab, transporting the thin slab from the regenerative furnace to a holding furnace located downstream of the regenerative furnace; and transporting the thin slab from the holding furnace to the rolling train for obtaining therein an end product.

2. The method of claim 1, further comprising the steps of:

forming the movable furnace part and the regenerative furnace as roller-bottom pivotable furnaces;

pivoting the movable furnace part and the regenerative furnace into respective inclined positions by a same angle in the opposite direction so that adjacent ends thereof form a linear connection for transporting the thin slab from the movable furnace part into the regenerative furnace, whereby the thin slab is transported from the respective casting line to the pitch line; and thereafter returning the movable furnace part and the regenerative furnace to their initial positions.

3. The method of claim 1, further comprising the steps of:

forming the movable furnace part and the regenerative furnace as roller-bottom "ferries";

displacing the movable furnace part and the regenerative furnace in the opposite direction by a same amount relative to the pitch line so that adjacent ends thereof form a linear connection for transporting the thin slab from the movable furnace part into the regenerative furnace, whereby the thin slab is transported from the respective casting line to the pitch line; and thereafter returning the movable furnace part and the regenerative furnace to their initial positions.

4. The method of claim 1, further comprising the steps of:

forming the movable furnace part and the regenerative furnace as roller-bottom pivotable furnaces;

pivoting the movable furnace part and the regenerative furnace in the opposite direction into the intermediate space between the respective casting line and the pitch line by a same amount so that adjacent ends thereof form a linear connection for transporting the thin slab from the movable furnace part into the regenerative furnace whereby the thin slab is transported from the respective casting line to the pitch line; and thereafter returning the movable furnace part and the regenerative furnace to their initial positions.

5. An arrangement for continuously casting and rolling down a hot-rolled wide strip said arrangement comprising:

a pitch line including a regenerative furnace, a holding furnace located downstream of the regenerative furnace, and a rolling train located downstream of the holding furnace;

at least two casting lines for continuously casting a cast strand and arranged on opposite sides of the pitch line;

means for cutting off a thin slab from the cast strand and located downstream of each of said two casting lines;

an equalizing furnace located downstream of each cutting means coaxially therewith for homogenizing the thin slab and bringing it to a predetermined temperature;

a movable furnace part located downstream of each equalizing furnace coaxially therewith and formed as one of a regenerative furnace part, a buffer portion and an equalizer portion;

wherein at least one of the movable furnace parts and said regenerative furnace, which cooperates with said at least one of the movable furnace parts have means for connecting said regenerative furnace and said at least one of the movable furnace parts with each other for transporting the thin slab from a respective casting line to said pitch line, and direction reversing means for enabling transportation of the thin slab.

6. The arrangement of claim 5, wherein said regenerative furnace is located parallel to the equalizing furnaces in a spaced relationship thereto, and has an end facing the rolling train and located substantially in the same plane as the rolling train facing ends of said equalizing furnaces.

7. The arrangement of claim 5, wherein said at least one of the movable furnace parts and said regenerative furnace are formed each as a roller-bottom pivoting furnace and a longitudinally offset relative to each other by approximately by a length of the movable furnace part, and wherein pivot points of the movable furnace parts are located at rear ends thereof and a pivot point of the regenerative furnace is located at a front end thereof, whereby said at least one of the movable furnace parts and said regenerative furnace in respective pivoted positions thereof form, in a switch-like manner, a crossover for transporting the thin slab from the respective casting line to said pitch line.

8. The arrangement for claim 5, wherein said at least one of the movable furnace parts and said regenerative furnace are formed each at a "ferry" with means for transporting the thin slab in at least one of longitudinal and transverse direction, whereby said at least one of the movable furnace part and said regenerative furnace, in mutually displaced transverse positions thereof in an intermediate space between the respective casting line and said pitch line, with adjacent ends thereof being connected to each other, form linear crossover for transporting the then slab from said at least one of the movable parts into said regenerative furnace and thereby from the respective casting line to said pitch line.

9. The arrangement of claim 5, wherein said at least one of the movable furnace parts and said regenerative furnace are formed each as a pivotable furnace displaceable parallel to itself and having a pivotable crank mechanism, and wherein said at least one of the movable furnace parts and said regenerative furnace, in displaced pivoted positions thereof, have adjacent ends thereof connected, in an intermediate space between the respective casting line and said pitch line, along a straight line.

10. The arrangement of claim 5, wherein said pitch line further includes an additional casting machine, a shortened roller bottom equalizing furnace located downstream of said additional casting machine, a movable regenerative furnace located downstream of said equalizing furnace and formed as one of a pivoting furnace and a parallel-displaceable furnace, and one of a holding furnace and an elongate holding furnace located downstream of said movable furnace.

11. An arrangement for continuously casting and rolling down a hot-rolled wide strip, said arrangement comprising:

first and second casting lines for casting a cast strand and extending parallel to each other;

first means for cutting off a thin slab from the cast strand and located downstream of said first casting line;

a pitch line formed coaxially with the first casting line and including downstream of said first cutting means arranged one after another, a first equalizing furnace, a first regenerative furnace, a first holding furnace, and a rolling train; and arranged one after another coaxially with the second casting line, a second cutting means, a second equalizing furnace, a second regenerative furnace, and a second holding furnace;

wherein said first regenerative furnace and said second holding furnace have means for connecting said first regenerative furnace and said second holding furnace with each other for transporting a thin slab from the second casting line to the pitch line, and direction reversing means for enabling transportation of the thin slab.

* * * * *